United States Patent [19]

Chang et al.

[11] Patent Number: 5,033,203

[45] Date of Patent: Jul. 23, 1991

[54] CURING OVEN USING WELLSBACH CONVERSION

[75] Inventors: David B. Chang, Tustin; James E. Drummond, Oceanside; Slava A. Pollack, Verdes Estate; I-Fu Shih, Los Alamitos, all of Calif.

[73] Assignee: Hughes Aircraft Company, Los Angeles, Calif.

[21] Appl. No.: 483,619

[22] Filed: Feb. 23, 1990

[51] Int. Cl.[5] ..... F25B 3/28; F25B 7/00; F25B 19/00

[52] U.S. Cl. ..... 34/4; 34/17; 34/60; 118/620; 118/640; 118/642; 427/54.1

[58] Field of Search ..... 217/339, 341, 347; 34/4, 17 X, 60, 243 C; 118/620, 640, 641, 642; 427/54.1; 250/492.1, 493.1, 504 R

[56] References Cited

U.S. PATENT DOCUMENTS

| | | | |
|---|---|---|---|
| 3,324,687 | 6/1967 | Swinyar | 431/100 X |
| 3,649,157 | 3/1972 | Klaver et al. | 431/100 |
| 4,408,400 | 10/1983 | Colapinto | 34/4 |
| 4,546,553 | 10/1985 | Best | 118/642 X |
| 4,646,446 | 3/1987 | Bubley | 34/4 |
| 4,694,180 | 9/1987 | Salisbury et al. | 250/492.1 X |
| 4,755,673 | 7/1988 | Pollack et al. | 431/100 X |
| 4,776,895 | 10/1988 | Goldstein | 431/100 X |
| 4,882,853 | 11/1989 | Schaft | 34/4 X |

*Primary Examiner*—Henry A. Bennet
*Assistant Examiner*—Christopher Kilner
*Attorney, Agent, or Firm*—Michael W. Sales; Wanda K. Denson-Low

[57] ABSTRACT

An improved curing oven using Wellsbach conversion is disclosed. The present invention 10 provides an improved curing oven which cures materials with electromagnetic radiation in the ultraviolet region. The invention consists of a surface 12 lined with a layer of material 14 effective to radiate ultraviolet radiation in response to the application of infrared radiation. In a specific illustrative implementation, the invention 10 includes a second surface 18 overlying the first surface 12 providing a passageway therebetween. The oven temperature is set and maintained by a conventional temperature controller 20. The temperature controller 20 measures the oven temperature and controls a valve 22 which adjusts the gas pressure from a gas supply 24 to a set of oven burners 26. Air is supplied through inlet ports 28 included in the second surface 18.

9 Claims, 2 Drawing Sheets

CURING OVEN USING WELLSBACH CONVERSION

BACKGROUND OF THE INVENTION

1. Field of the Invention

The present invention relates to ovens. More specifically, the present invention relates to paint curing ovens.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Many automobile paint curing processes involve the baking of a painted object at high temperatures for long periods of time in conventional gas ovens. Cross-linking or curing of the paint is typically achieved by exposing the paint to infrared or heat radiation emitted by a gas flame.

It is generally known in the art that ultraviolet radiation is more efficient in curing paint at a lower temperature than that which would be used for infrared radiation. For this application, ultraviolet light provides the necessary cross-linking at lower temperatures with shorter processing times.

Cross-linking of the paint is no achieved in an efficient manner in conventional gas ovens which rely on infrared radiation to cure the paint. For this reason, there is a need in the art for an improved curing oven which achieves cross-linking of the paint at lower temperatures.

SUMMARY OF THE INVENTION

The need in the art is addressed by the present invention which provides an improved curing oven which cures materials with electromagnetic radiation i the ultraviolet region. The invention consists of a surface lined with a layer of material effective to radiate ultraviolet radiation in response to the application of infrared radiation. In a specific illustrative implementation, the invention includes a second surface overlying the first surface providing a passageway therebetween. A temperature controller sets and maintains the temperature inside the oven. The temperature controller measures the oven temperature and controls a valve which adjusts the gas pressure from a gas supply to a set of oven burners. Air is supplied through inlet ports included in the second surface.

DESCRIPTION OF THE INVENTION

Illustrative embodiments and exemplary applications will not be described with reference to the accompanying drawings t disclose the advantageous teachings of the present invention.

Figure 1:
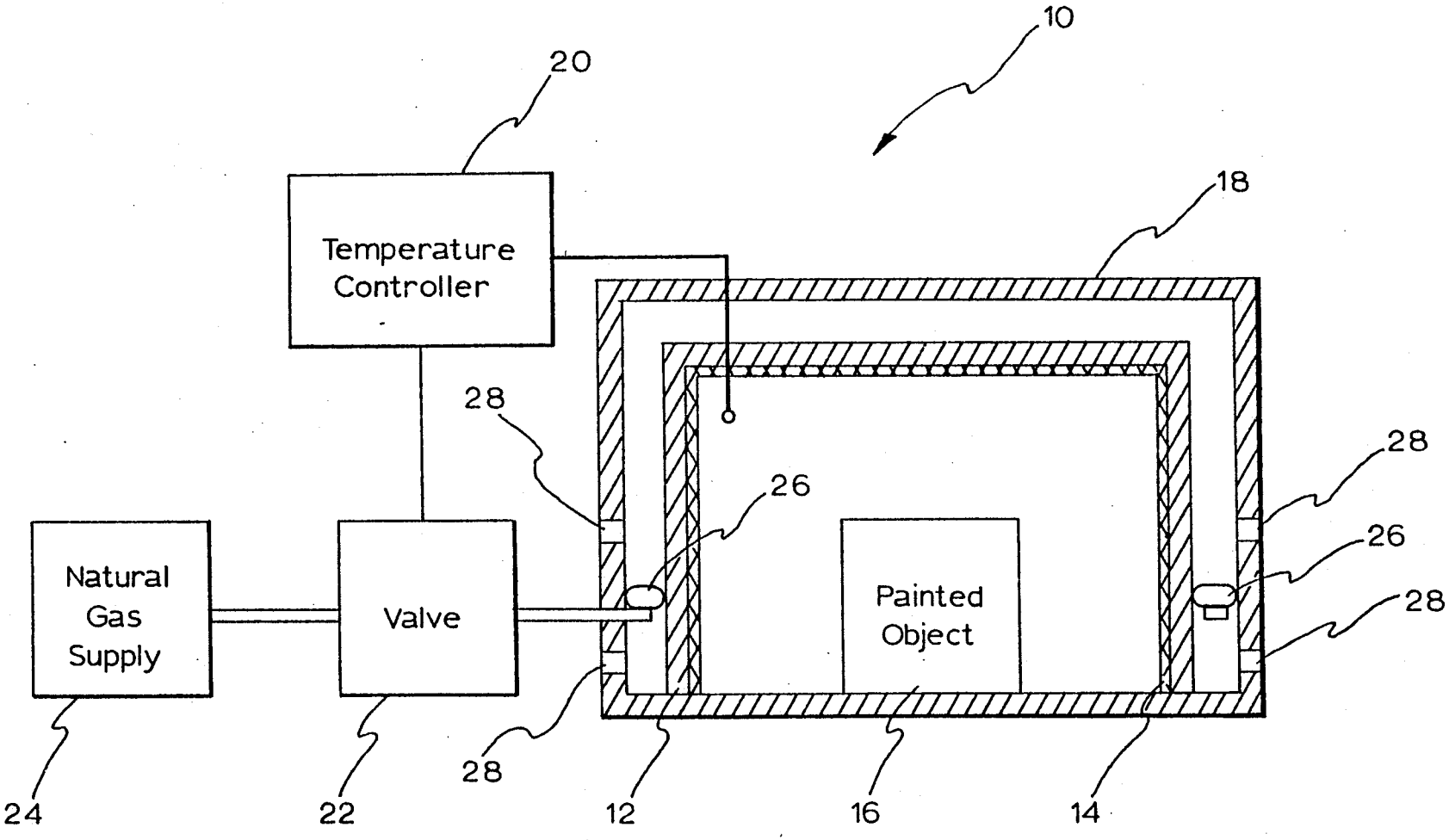
FIG. 1 shows a cross sectional view of an illustrative implementation of a curing oven constructed in accordance with the teachings of the present invention.

FIG. 1 shows a cross sectional view of an illustrative implementation of a curing oven constructed in accordance with the teachings of the present invention, shown in operative relationship to a painted object. The invention 10 consists of a surface 12 coated with a layer of Welsbach material 14 effective to radiate ultraviolet radiation in response to the application of infrared radiation. The Welsbach material 14 can be pained on to the surface 12 to a thickness of approximately 5–19 μm.

The Welsbach material (a selective radiator) is characterized by a wavelength-dependent emissivity such that the emissivity is high in the short wavelength (visible or ultra violet) region and low in the long wavelength (infrared) region. When this material is coated over a surface, the emission spectrum changes. Because of the low emissivity in the long wavelength region, most energy in infrared cannot radiate out. Instead, this energy is forced to radiate in the short wavelength region. Examples of the Welsbach material are $ThO_2$, MgO, $ZrO_2$ with 10% CaO, and $AL_2O_3$.

The surface 12 is constructed to encompass a panted object 16 to provide an even exposure of radiation to all surfaces of the painted object 16. The invention 10 includes a second surface 18 overlying the first surface 12 providing a passageway therebetween. The oven temperature is set and maintained by a conventional temperature controller 20. The temperature controller 20 measures the oven temperature and controls a valve 22 which adjusts the gas pressure from a gas supply 24 to a set of oven burners 26. Air is supplied through inlet ports 28 included in the second surface 18. The construction of various natural gas burners is well known. For example, see page 471–473, Van Nostrand's Scientific Encyclopedia, Sixth Edition (1983).

Figure 2:
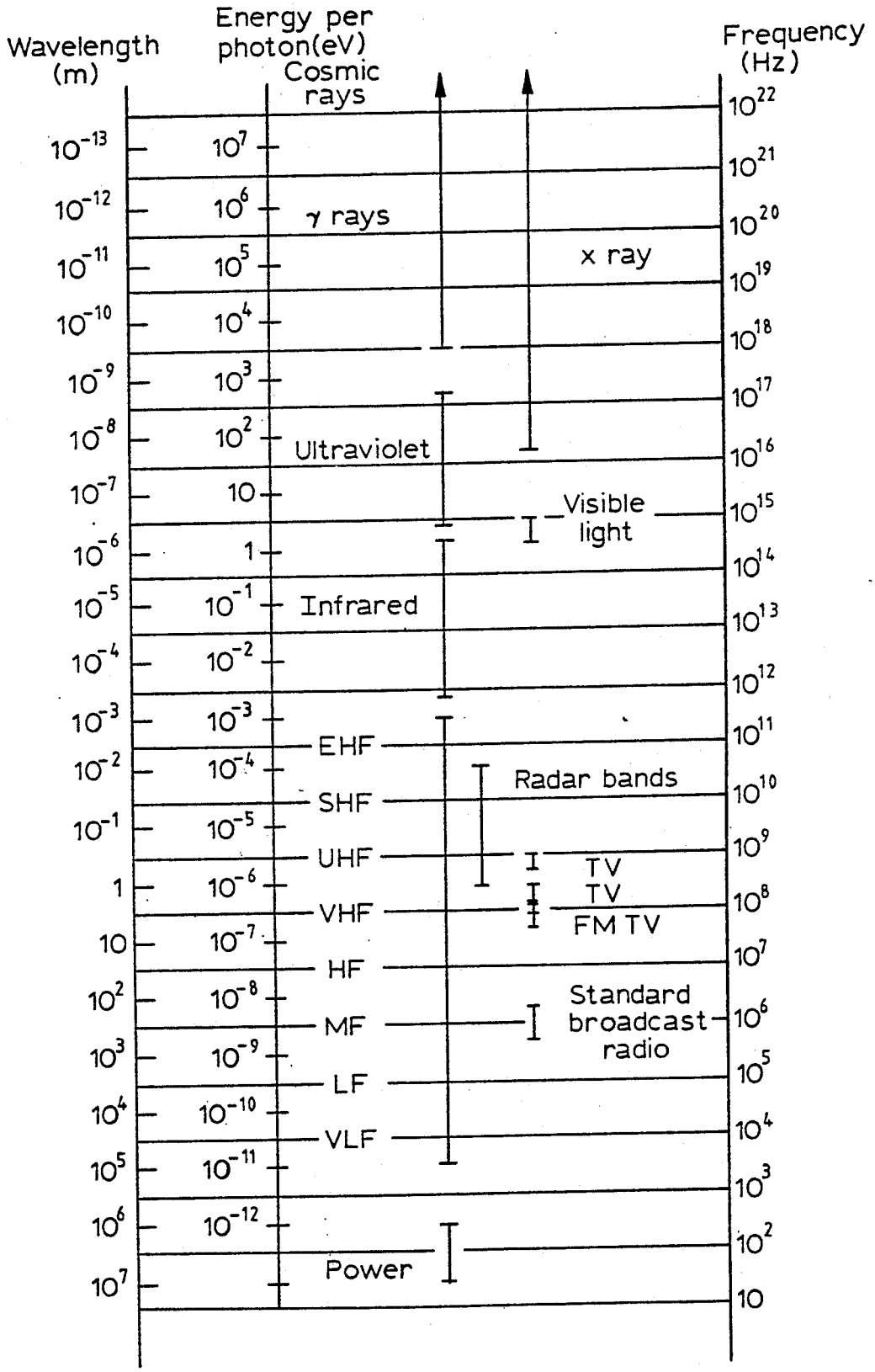
FIG. 2 shows the electromagnetic spectrum, including wavelength, frequency, and energy per photon on a logarithmic scale.

As shown in FIG. 2, ultraviolet and visible radiation have shorter wavelenghts than infrared or heat radiation. The wavelength λ of the electromagnetic radiation is related to the frequency v by:

$$v=c/\lambda \qquad [1]$$

where c is the speed of light. The energy E of each photon can be then be calculated from equation [2] below:

$$E=hv \qquad [2]$$

where h is Planck's constant. Higher frequency radiation consists of higher energy photons which break molecules more efficiently. Increasing ultraviolet and visible radiation produce cross-links in the paint more quickly that that of infrared or heat radiation alone, thus reducing curing times. Since Welsbach material has a property of converting infrared radiation into radiation rich in visible and ultraviolet radiation, proper application of this material can boost ultraviolet radiation without increasing input power.

Thus, the present invention has been described herein with reference to a particular embodiment for a particular application. Those having ordinary skill in the art and access to the present teachings will recognize additional modifications applications and embodiments within the scope thereof. For example, the invention is not limited to the use of gas ovens. The invention can be applied to ovens utilizing lamps or any other oven designs using infrared radiation.

Further, the invention is not limited to the curing of paint. It will be appreciated by those skilled in the art that the invention can be applied to curing ovens used for curing plastics, bonding, and other materials requiring oven curing.

It is therefore intended by the appended claims to cover any and all such applications, modification and embodiments within the scope of the present invention.

Accordingly,

What is claimed is:

1. An improved oven for curing an item comprising:

container means for housing said item, said container means having at least one surface for radiating energy to cure said item;

a layer of material overlaying said surface effective to radiate ultraviolet radiation in response to the application of infrared radiation to said layer; and heating means for applying said infrared radiation to said layer of material.

2. The invention of claim 1 wherein said layer of material includes a lining of Welsbach material.

3. The invention of claim 1 wherein said heating means includes a gas flame.

4. The invention of claim 1 wherein said heating means includes electric lamps.

5. Am improved curing oven comprising:

a first surface coated with a layer of material effective to radiate ultraviolet radiation in response to the application of infrared radiation to said first surface;

a second surface overlying and separated from said first surface;

a passageway between said surfaces;

at least one port in said passageway for in taking air; and burner means in said passageway for applying heat to said first surface.

6. The invention of claim 5 wherein said fuel includes natural gas.

7. A method for curing paint including the steps of:

radiating with infrared radiation a layer of material effective to radiate ultraviolet radiation in response to the application of infrared radiation thereto; and exposing said paint to said ultraviolet radiation to cure said paint.

8. The method of claim 7 wherein the step of radiating said layer of material includes heating said layer of material using a gas flame.

9. The method of claim 7 wherein the step of radiating said layer of material includes heating said layer of material using electric lamps.

* * * * *